US005181531A

United States Patent [19]

Escoto et al.

[11] Patent Number: 5,181,531

[45] Date of Patent: Jan. 26, 1993

[54] TOOTH CLEANING KIT FOR VENDING MACHINES

[76] Inventors: Dario Escoto, 261 Seaman Ave. #10-A, New York, N.Y. 10034; George Spector, 233 Broadway Room 3815, New York, N.Y. 10007

[21] Appl. No.: 732,484

[22] Filed: Jul. 18, 1991

[51] Int. Cl.[5] ..... A46B 11/00

[52] U.S. Cl. ..... 132/308; 206/581; 401/7; 401/186; 401/279; 401/280; 132/309

[58] Field of Search ..... 132/308, 309; 206/581, 206/229; 401/8, 7, 186, 280, 279

[56] References Cited

U.S. PATENT DOCUMENTS

| | | | |
|---|---|---|---|
| 1,505,442 | 8/1924 | Stephens | 401/186 X |
| 1,947,720 | 2/1934 | Laub | 401/7 |
| 2,075,681 | 3/1937 | Welker | 401/7 |
| 2,223,952 | 12/1940 | Darmody | 132/308 |
| 2,638,614 | 5/1953 | Anderson | 401/280 |
| 4,530,129 | 7/1985 | Labick et al. | 132/308 X |
| 5,074,414 | 12/1991 | Romana | 206/581 X |

FOREIGN PATENT DOCUMENTS

| | | | |
|---|---|---|---|
| 313689 | 5/1989 | European Pat. Off. | 206/581 |
| 384258 | 10/1923 | Fed. Rep. of Germany | 132/308 |

*Primary Examiner*—Steven A. Bratlie

[57] ABSTRACT

A tooth cleaning kit for a vending machine is provided and consists of a small package to be dispensed from the vending machine. A toothbrush, a small tube of toothpaste, a napkin and a piece of dental floss are sealed in the small package so that a person can purchase, use and then dispose the tooth cleaning kit.

1 Claim, 1 Drawing Sheet

TOOTH CLEANING KIT FOR VENDING MACHINES

BACKGROUND OF THE INVENTION

The instant invention relates generally to disposable dental products and more specifically it relates to a tooth cleaning kit for a vending machine which provides a small package containing a toothpaste tube, a toothbrush, a napkin and a string of dental floss.

There are available various conventional disposable dental products which do not provide the novel improvements of the invention herein disclosed.

SUMMARY OF THE INVENTION

A primary object of the present invention is to provide a tooth cleaning kit for a vending machine that will overcome the shortcomings of the prior art devices.

Another object is to provide a tooth cleaning kit for a vending machine that consists of a small package containing a tube of toothpaste, a toothbrush, a napkin and a dental floss string which is dispensed from the vending machine.

An additional object is to provide a tooth cleaning kit for a vending machine in which the toothbrush is designed to slip onto a finger, release toothpaste onto the bristles and can be used more than once.

A further object is to provide a tooth cleaning kit for a vending machine that is simple and easy to use.

A still further object is to provide a tooth cleaning kit for a vending machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
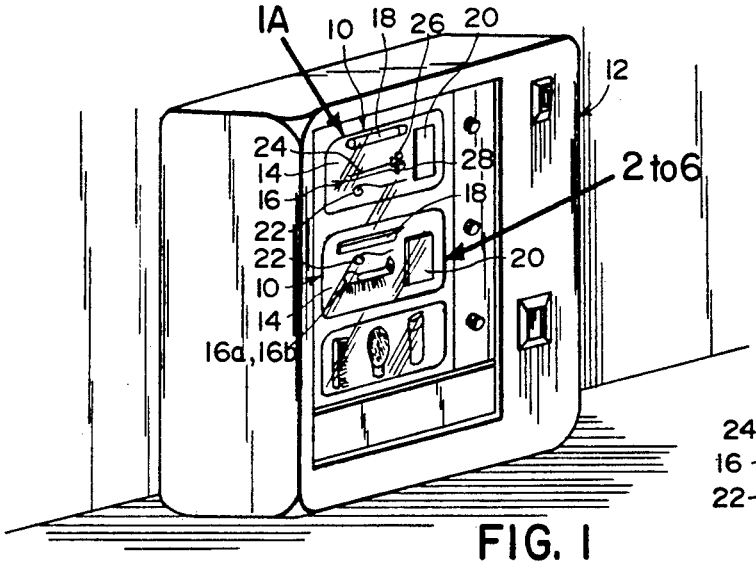
FIG. 1 is a perspective view showing the instant invention and a modification of the invention packaged and within a vending machine.
Figure 1A:
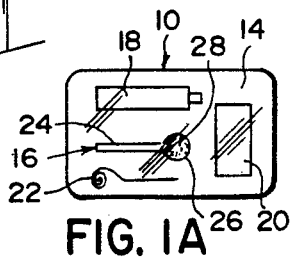
FIG. 1A is a top plan view of the packaged instant invention.

Turning now descriptively to the drawings, in which similar reference characters denote similar elements throughout the several views, FIGS. 1 and 1A illustrate a tooth cleaning kit 10 for a vending machine 12 consisting of a small package 14 to be dispensed from the vending machine 12, a toothbrush 16, a small tube of toothpaste 18, a napkin 20 and a piece of dental floss 22 are all sealed in the small package 14 so that a person can purchase, use and then dispose the tooth cleaning kit 10

The toothbrush 16 includes a handle 24 to be gripped by the hand of the person, a round head 26 on one end of the handle 24 and a plurality of bristles 28 extending from the round head 26 for cleaning the teeth of the person after toothpaste from the small tube 18 is applied onto the bristles 28.

Figure 2:
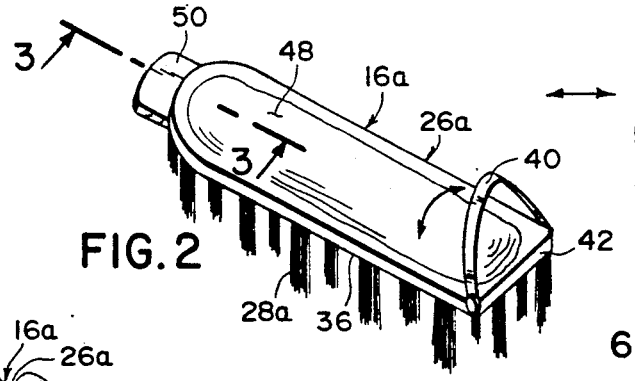
FIG. 2 is a perspective view of a first modified toothbrush.
Figure 3:
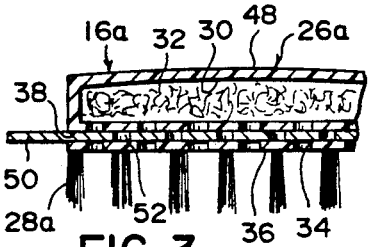
FIG. 3 is a cross sectional view taken along line 3—3 in FIG. 2 showing the sliding valve plate in greater detail.
Figure 4:
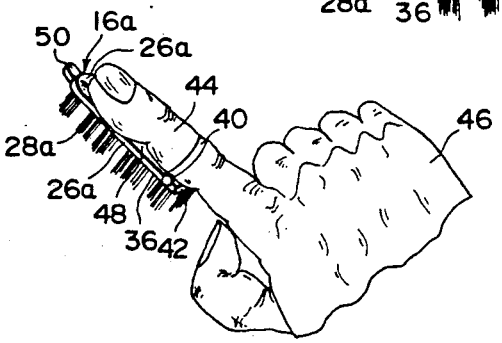
FIG. 4 is a perspective view of the first modified toothbrush worn on a finger of a person.

FIGS. 2 to 4 show a first modified toothbrush **16*a* which includes a generally flat head 26*a* having a compressible compartment 30 for storage of toothpaste 32 therein, a plurality of apertures 34 on the underside 36 of the flat head 26*a* in communication with the compartment 30 and a longitudinal slot 38 within the underside 36 of the flat head 26*a* to intersect the apertures 34**.

A plurality of bristles **28*a* extends from the underside of the flat head 26*a* for cleaning the teeth. A band 40 is affixed to the rearward end 42 of the flat head 26*a* and curves upwardly therefrom so that a finger 44 of a hand 46 of the person can be inserted between the band 40 and the top surface 48 of the flat head 26*a*. A valve plate 50 having a plurality of holes 52 therethrough is provided. The valve plate 50 slideably fits into the longitudinal slot 38 in the flat head 26*a*. When the valve plate 50 is properly positioned the holes 52 will align up with the apertures 34. The finger 44 can compress the compartment 30 in the flat head 26*a* allowing the toothpaste 32 to exit the apertures 34 and be applied onto the bristles 28*a***.

Figure 5:
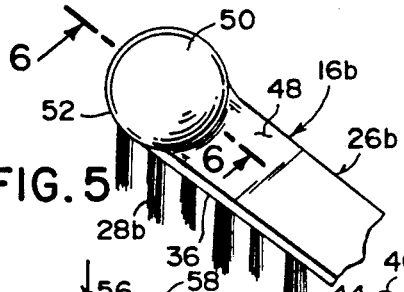
FIG. 5 is a perspective view with parts broken away of a second modified toothbrush.
Figure 6:
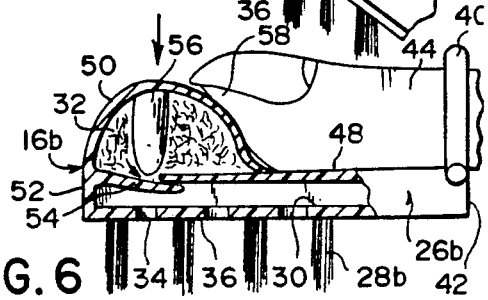
FIG. 6 is a cross sectional view taken along line 6—6 in FIG. 5, showing the one way release valve and plunger within the bubble segment of the head.

FIGS. 5 and 6 show a second modified toothbrush **16*b* which includes a generally flathead 26*b* having a compressible compartment 30 for storage of toothpaste 32 therein and a plurality of apertures 34 on the underside 36 of the flat head 26*b*. A plurality of bristles 28*b* extends from the underside 36 of the flat head 26*b* for cleaning the teeth. A band 40 is affixed to the rearward end 42 of the flat head 26*b* and curves upwardly therefrom so that a finger 44 of a hand 46 of the person can be inserted between the band 40 and the top surface 48 of the flat head 26*b*. A compressible bubble segment 50 is formed on the forward end 52 of the flat head 26*b* for storage of the toothpaste 32 therein. A one way valve 54 is in the forward end 52 of the flat head 26*b* below the bubble segment 50 and a plunger 56 is in the compressible bubble segment 50 to open the one way valve 54 when the tip 58 of the finger 44 compresses the bubble segment 50 allowing the toothpaste 32 to exit the apertures 34 and be applied onto the bristles 28*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tooth cleaning kit for a vending machine which comprises:

a) a small package to be dispensed form the vending machine;

b) a toothbrush sealed in said small package;

c) a small tube of toothpaste sealed in said small package;

d) a napkin sealed on said small package;

e) a piece of dental floss sealed in said small package so that a person can purchase, use and then dispose said tooth cleaning kit, wherein said tooth brush includes:

f) a generally flat head with an underside having a compressible compartment for storage of toothpaste therein and there a plurality of apertures on the underside of said flat head;

g) a plurality of bristles extending from the underside of said flat head for cleaning the teeth;

h) a band affixed to the rearward end of said flat head and curving upwardly therefrom so that a finger of a hand of the person can be inserted between said band and the top surface of said flat head;

i) a compressible bubble segment formed on the forward end of said flat head above said compartment for storage of he toothpaste therein;

j) a one way valve in the forward end of said flat head below said bubble segment; and k) a plunger in said compressible bubble segment aligned with said one way valve whereby compression of said bubble segment by the users finger causes said plunger to open said valve and simultaneously force toothpaste from said bubble segment into said compartment and out of said apertures to said bristles.

* * * * *